US010910180B2

(12) United States Patent
Masumoto

(10) Patent No.: US 10,910,180 B2
(45) Date of Patent: Feb. 2, 2021

(54) ACTUATOR

(71) Applicant: DAICEL CORPORATION, Osaka (JP)

(72) Inventor: Takaya Masumoto, Hyogo (JP)

(73) Assignee: Daicel Corporation, Osaka (JP)

( * ) Notice: Subject to any disclaimer, the term of this patent is extended or adjusted under 35 U.S.C. 154(b) by 21 days.

(21) Appl. No.: 16/221,305

(22) Filed: Dec. 14, 2018

(65) Prior Publication Data

US 2019/0122842 A1 Apr. 25, 2019

Related U.S. Application Data

(63) Continuation of application No. PCT/JP2017/021994, filed on Jun. 14, 2017.

(30) Foreign Application Priority Data

Jun. 17, 2016 (JP) ..... 2016-120779

(51) Int. Cl.
*H01H 39/00* (2006.01)
*F42B 3/103* (2006.01)

(52) U.S. Cl.
CPC ..... *H01H 39/006* (2013.01); *F42B 3/103* (2013.01); *H01H 39/00* (2013.01); *H01H 39/004* (2013.01)

(58) Field of Classification Search
CPC ..... B60R 2021/26029; B60R 21/272; B60R 22/4628; B60R 2021/2633;
(Continued)

(56) References Cited

U.S. PATENT DOCUMENTS 3,334,204 A 8/1967 Brenny et al.
3,802,430 A 4/1974 Schwebel et al.
(Continued)

FOREIGN PATENT DOCUMENTS

JP 2000-251599 A 9/2000
JP 2013-522834 A 6/2013
(Continued)

OTHER PUBLICATIONS

Extended European Search report dated Feb. 10, 2020 in European Application No. 17813359.1, in 8 pages.
(Continued)

*Primary Examiner* — Ahmed M Saeed
(74) *Attorney, Agent, or Firm* — Knobbe Martens Olson & Bear LLP

(57) ABSTRACT

An injector can include an ignition device including a partition wall member forming a first space for housing a gunpowder and made from a rigid material to be destroyed by a rise in pressure in the first space in a case that the gunpowder is combusted. The actuator can also include a casing including a base portion being fixed to the actuator body near the ignition device, and being disposed in a space inside the actuator body covering the ignition device. The casing can define a second space between the casing and the partition wall member of the ignition device, and seal, inside the second space, a combustion product generated by combustion of the gunpowder by the ignition device. When pressure inside the second space arises due to combustion of the gunpowder, a portion of the casing can stretch to approach a predetermined end portion of the output piston portion.

18 Claims, 4 Drawing Sheets

(58) Field of Classification Search
CPC ..... B60R 21/2644; B60R 21/268; B60R 2021/26094; B60R 21/0173; B60R 21/18; H01H 39/006; H01H 39/00; H01H 37/76; H01H 33/06; H01H 2037/768; H01H 85/18; F42B 3/103
See application file for complete search history.

(56) References Cited

U.S. PATENT DOCUMENTS

| | | | | |
|---|---|---|---|---|
| 6,199,905 | B1 * | 3/2001 | Lewis | B60R 21/18 280/737 |
| 6,418,005 | B1 | 7/2002 | Endo et al. | |
| 7,063,019 | B2 | 6/2006 | Parks et al. | |
| 2004/0006979 | A1 | 1/2004 | Parks | |
| 2006/0027120 | A1 * | 2/2006 | Smith | F42B 3/006 102/202.12 |
| 2013/0056344 | A1 | 3/2013 | Borg | |
| 2014/0061161 | A1 | 3/2014 | Nakamura et al. | |

FOREIGN PATENT DOCUMENTS

| | | | |
|---|---|---|---|
| JP | 2014-049300 | A | 3/2014 |
| JP | 2014-104112 | A | 6/2014 |
| KR | 10-2012-0004897 | A | 1/2012 |

OTHER PUBLICATIONS

International Search Report and Written Opinion dated Aug. 22, 2017 in International Application No. PCT/JP2017/021994.

* cited by examiner

ACTUATOR

CROSS-REFERENCE TO RELATED APPLICATIONS

This application is a continuation application, and claims the benefit under 35 U.S.C. §§ 120 and 365 of PCT Application No. PCT/JP2017/021994, filed Jun. 14, 2017, which is hereby incorporated by reference. PCT/JP2017/021994 also claimed priority to Japanese Patent Application No. 2016-120779, filed Jun. 17, 2016, the entire contents of which are incorporated by reference.

BACKGROUND

Field

The described technology generally relates to an actuator which exerts a predetermined force to a target object via an output piston portion.

Description of the Related Technology

An electrical circuit may be provided with an cut-off device which cuts off an electrical connection between devices by being activated upon failure of any of the parts constituting the electrical circuit or upon failure of a system on which the electrical circuit is mounted. As one such embodiment, there has been proposed an electrical connection cut off device in which a cutting member is moved at high speed by high-pressure gas and forcibly and physically cuts a conducting material placed between devices. For example, according to the technology in JP 2014-49300, a cutting member is activated by high-pressure gas produced by a gas generator, cuts a conductor that forms a portion of the electrical circuit, and extinguishes an arc that occurs between cut end portions of the conductor produced by the cutting. Thus, a more reliable interruption of electrical connection is achieved.

Further, an actuator for pressurization using a combustion energy of a gunpowder has also been developed. When a gunpowder is used in this way, often an igniter is used. For example, U.S. Pat. No. 7,063,019 discloses an igniter that uses the combustion energy of a gunpowder. According to this technology, a peripheral wall portion of a cup that forms an outer shell of the igniter is formed into a bellows shape, and the bellows-shaped portion is compressed in an axial direction of the cup before the gunpowder inside the igniter is combusted. Then, the bellows portion will be stretched as the pressure inside the igniter increases, and a position of a leading end portion of the cup advances in the axial direction of the cup when the gunpowder inside the igniter is combusted. The use of such an advancing action (e.g., thrusting motion) of the leading end portion of the cup as an output portion of an actuator is also disclosed in U.S. Pat. No. 7,063,019.

SUMMARY

To efficiently use the combustion energy of a gunpowder as a power source in an actuator which exerts a predetermined force to a target object, the combustion energy that is produced needs to be efficiently transmitted to an output piston portion of the actuator. For the purpose of this, it is important to keep a combustion product produced by the combustion of the gunpowder in a fixed closed space, and increase the pressure of the interior.

Further, by thus keeping the combustion product in a fixed closed space, it is possible to suppress undesirable effects of the combustion product.

On the other hand, according to such an igniter as described above, it is possible to exert pressure utilizing the advancing action of the leading end portion of the cup while keeping, inside the cup, the combustion product produced by the combustion of the gunpowder. However, when the bellows portion provided to the cup of the igniter will be stretched with the pressure of the internal space caused by the combustion of the ignition charge, there is a possibility that a combustion speed of the gunpowder is affected, causing the combustion speed of the gunpowder to become slow because a volume of the internal space of the igniter increases by the stretching of the bellows portion. Thus, the pressure rise in the internal space of the igniter may also become slow, decreasing the output of the output piston portion and making it difficult to efficiently apply the predetermined force even when the above described igniter is utilized as a power source of an actuator.

In light of the problems described above, an object of the present invention is to make an actuator, which is driven by the combustion of a gunpowder, be capable of efficiently exerting a predetermined force.

To solve the above-described problems, according to embodiments of the present invention, a gunpowder inside an ignition device of an actuator is housed inside a first space formed by a partition wall member which will be destroyed by a pressure rise, while a combustion product of the gunpowder is continually kept inside a second space provided in an interior of a casing that houses the ignition device, which casing will not be destroyed by a pressure rise in the second space. Further, the casing includes a stretchable portion, and thus a portion of the casing advances by the pressure rise inside the second space, transmitting the combustion energy of the gunpowder to an output piston portion.

Specifically, an actuator according to embodiments of the present invention includes an actuator body including a through-hole formed in an axial direction, an output piston portion slidably disposed inside the through-hole, the output piston portion being configured to protrude from an output surface of the actuator body and apply a predetermined force to a target object, an ignition device including a partition wall member forming a first space for housing a gunpowder and made from a predetermined rigid material so as to be destroyed by a rise in pressure in the first space in a case that the gunpowder is combusted, and a casing including a base portion fixed to the actuator body near the ignition device, and being disposed in a space inside the actuator body covering the ignition device, the casing defining a second space between the casing and the partition wall member of the ignition device, and sealing, inside the second space, a combustion product generated by combustion of the gunpowder by the ignition device. The casing includes a stretchable portion configured to, via a rise in pressure inside the second space from combustion of the gunpowder inside the ignition device, stretch in an approaching direction and cause a portion of the casing to approach a predetermined end portion of the output piston portion opposite an end portion that protrudes from the output surface, and a pressing portion provided to the portion of the casing and configured to press the predetermined end portion of the output piston portion via stretching of the stretchable portion.

In the above actuator, the energy produced by the combustion of the gunpowder in the ignition device is transmitted to the output piston portion, causing the output piston portion to slide inside the through-hole. Then, the output piston portion protrudes from the output surface of the actuator body, allowing the end portion of the output piston portion thus protruded to apply a predetermined force to a target object. Note that transmission of the energy to the output piston portion by the combustion of the gunpowder is performed via the casing as described later. In the actuator of the present invention, the detailed components of the gunpowder are not limited to specific components.

The combustion product disperses in the first space formed by the partition wall member and the pressure inside the first space rises when the gunpowder in such an ignition device is combusted.

Here, the partition wall member is made from a predetermined rigid material so as to be destroyed when the pressure in the first space rises, and thus the first space does not deform substantially until the partition wall member is destroyed. This allows the pressure inside the first space to rapidly rise as soon as the gunpowder starts to be combusted. As for the predetermined rigid material, a resin material can be suitably used. Then, the combustion product of the gunpowder is dispersed inside the second space when the partition wall member is destroyed by the pressure inside the first space. Here, as described above, the pressure inside the first space rapidly rises due to the partition wall member, and thus the combustion of the gunpowder rapidly advances without becoming sluggish during combustion. This contributes to the rapid transmission of the combustion energy to the output piston portion.

Here, the casing that forms the second space, unlike the partition wall member of the ignition device, is not destroyed even when the pressure in the second space rises, and thus the combustion product of the gunpowder is kept in the second space. Further, when the pressure in the second space rises, the stretchable portion of the casing stretches, bringing the portion of the casing close to the predetermined end portion of the output piston portion and causing the predetermined end portion to be pressed by the pressing portion provided to the portion of the casing. With such deformation of the casing, the energy resulting from the combustion of the gunpowder is transmitted to the output piston portion.

As described above, according to embodiments of the present invention, the rapid increase of the pressure in the first space becomes easy by combusting the gunpowder inside the first space formed by the partition wall member. Then, the stretchable portion is stretched by the combustion of the gunpowder, and the output piston portion is pressed by the pressing portion, thereby driving the output piston portion. Thus, according to embodiments of the present invention, rapid combustion of the gunpowder is achieved, making it possible to efficiently apply a predetermined force to a target object. Further, in the pressing process by the pressing portion, the combustion product of the gunpowder is maintained in a sealed state inside the second space.

Therefore, the effect of combustion residue and the like can be avoided. Further, noise produced by the combustion of the gunpowder (combustion noise) is less likely to leak outside the space because the sealed state at the second space is being maintained.

Here, in the actuator described above, the second space may house a gas generating agent for generating a predetermined gas by combustion, and the stretchable portion may be configured to stretch the portion of the casing in the approaching direction by a pressure rise in the second space from combustion of the gunpowder in the ignition device and combustion of the gas generating agent. According to such a configuration, when the partition wall member is destroyed by the pressure inside the first space by the combustion of the gunpowder, the gas generating agent housed in the second space starts the combustion by being exposed to and receiving the heat from the combustion product of the gunpowder. Here, the pressure inside the first space rapidly rises due to the partition wall member, and thus the combustion of the gas generating agent is quickly started. This contributes to the quick transmission of the combustion energy to the output piston portion.

Then, when the gas generating agent starts combustion, the produced predetermined gas is dispersed in the second space, and the pressure inside the second space rises, causing the stretchable portion to stretch and the predetermined end portion to be pressed by the stretchable portion, and in this way the energy generated by the combustion of the gunpowder and the gas generating agent will be transmitted to the output piston portion. According to such a configuration as well, the combustion product of the gunpowder and the predetermined gas resulting from the gas generating agent are sealed inside the second space. Accordingly, external release of the predetermined gas can be suppressed, and the noise produced by the combustion of the gunpowder and the gas generating agent (combustion noise) can be suppressed. In the actuator of according to embodiments of the present invention, the detailed components of the gas generating agent are not limited to specific components.

Here, in the actuator described above, the said stretchable portion may be formed by being folded into a bellows shape in a pre-combustion state of the gunpowder in the ignition device, in a side wall portion of the casing facing an inner wall surface extending in the axial direction of the actuator body, and may be configured to stretch in the axial direction by combustion of the gunpowder in the ignition device. With the stretchable portion thus formed into a bellows shape, the bellows portion folded is deployed by the pressure rise in the second space, allowing the pressing portion provided to the portion of the casing to be brought close to the predetermined end surface of the output piston portion.

Further, in the actuator described above, the portion of the casing may include an end surface that is on a leading end side of the casing. and the area of the end surface may be formed so as to be greater than a surface area of an end surface of the predetermined end portion of the output piston portion. With such a configuration, when the stretchable portion is stretched, the pressing portion provided on the end surface of the casing more reliably comes into contact with the predetermined end portion of the output piston portion and allows the combustion energy of the gunpowder or the like to be transmitted to the output piston portion. With such a configuration, the combustion energy of the gunpowder or the like will be made possible to be transmitted to the output piston portion because the pressing portion provided on the end surface of the casing more reliably comes into contact with the predetermined end portion of the output piston portion when the stretchable portion is stretched.

Note that, as described above, in the configuration in which the pressing portion presses the predetermined end portion of the output piston portion as a result of the stretching of the stretchable portion, a relatively large pressure is applied to the portion of the casing where the pressing portion is provided by the combustion of the gunpowder or the gas generating agent. Here, to increase a strength of the area where the pressure is applied, the portion of the said casing may be formed so as to have a thickness greater than a thickness in other portions of the casing. Further, as an alternative method for reinforcing said area, the actuator may further include a reinforcing plate having a predetermined thickness and provided to the portion of the casing, on the inside or outside of the casing. Note that, taking into consideration the pressure applied to the portion of the casing, the predetermined thickness of the reinforcing plate is a thickness adequate enough to prevent the casing from being destroyed when pressed by the pressing portion.

Here, in the actuator described above, the casing may be disposed inside the actuator body with the pressing portion in contact with the predetermined end portion of the output piston portion in the pre-combustion state of the gunpowder in the ignition device. With such an arrangement, the pressure can be quickly transmitted to the output piston portion when the pressure in the second space starts to rise.

Further, the actuator described above may, in a state where the stretchable portion is fully stretched via combustion of the gunpowder in the ignition device, be configured such that a predetermined gap exists between the portion of the casing and a predetermined inner wall surface forming an internal space of the actuator body, located in a vicinity of an end portion of the through-hole, and facing the portion of the casing. With such a configuration, even when the stretchable portion is fully stretched, it is possible to avoid the portion of the casing being in contact with the predetermined inner wall surface. This makes it possible to prevent a relatively large impact from being applied from the predetermined inner wall surface to the portion of the casing when the stretchable portion is fully stretched, and thus contributes to maintaining the sealed state of, including but not limited to, the combustion product in the second space. Alternatively, in the actuator described above, a cushioning member may be provided on a predetermined inner wall surface forming an internal space of the actuator body, located in a vicinity of an end surface of the through-hole, and facing a portion of the casing. In this case, the cushioning member is configured to stop the stretching of the stretchable portion upon contact with the stretchable portion in a case that the stretchable portion is stretched by the combustion of the gunpowder in the ignition device. The portion of the casing is thus brought into contact with the predetermined inner wall surface with the cushioning member therebetween, making it possible to reduce the impact at the time of contact.

According to embodiments of the present invention, it is possible to provide an actuator that is driven by the combustion of a gunpowder and is capable of efficiently applying a predetermined force.

DETAILED DESCRIPTION

An actuator according to embodiments of the present invention will be described below with reference to the drawings. Note that the configurations of the following embodiments are exemplary, and the present invention is not limited to the configurations of these embodiments.

First Embodiment

Figure 1:
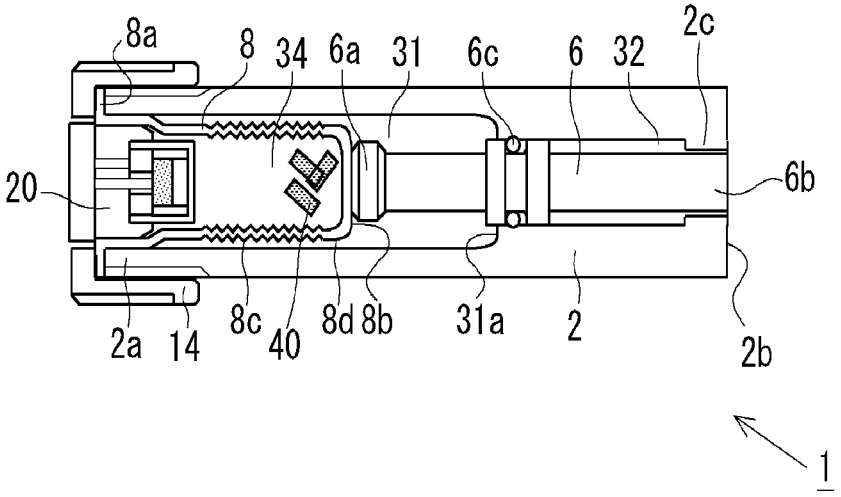
FIG. 1 is a diagram illustrating a schematic configuration of an actuator according to a first embodiment of the present invention.

FIG. 1 is a cross-sectional view of an actuator 1. Here, the actuator 1 includes an actuator body 2, and the side of a leading end of the actuator body 2 is the side of an output side of the actuator 1, that is, a side where a target object subject to a predetermined force is disposed. In the interior of the actuator body 2, an internal space 31 serving as an internal space extending in an axial direction of the actuator body 2, and a through-hole 32, similarly serving as an internal space extending in the axial direction of the actuator body 2, are formed. The internal space 31 and the through-hole 32 are the space continuously disposed in the interior of the actuator body 2.

Further, a surface on the leading end side of the actuator body 2 forms an output surface 2*b*. This output surface 2*b* is a surface facing the target object subject to a predetermined force when the actuator 1 is used. On the leading end side of the actuator body 2 is provided with a stopper portion 2*c* where a diameter of the through-hole 32 is reduced. Here, in the through-hole 32 of the actuator body 2 is disposed an output piston 6 made of metal. This output piston 6 is formed into a substantially shaft-like shape extending in an axial direction of the through-hole 32, and is slidably held inside the through-hole 32. The output piston 6 includes an end portion (hereinafter referred to as "first end portion") 6*a* on the inner space 31 side, and an end portion on the output surface 2*b* side, that is, an end portion (hereinafter referred to as "second end portion") 6*b* for applying [exerting] a predetermined force to the target object. Further, an O-ring 6*c* is disposed around the output piston 6 so that the output piston 6 can smoothly slide inside the through-hole 32. Here, in a state before the gunpowder is combusted in an initiator 20, which is an ignition device described later, (hereinafter referred to as a "pre-combustion state"), an end surface of the second end portion 6*b* is flush with the output surface 2*b* or is in a position further inserted inside the through-hole 32 from the output surface 2*b*.

Figure 5:
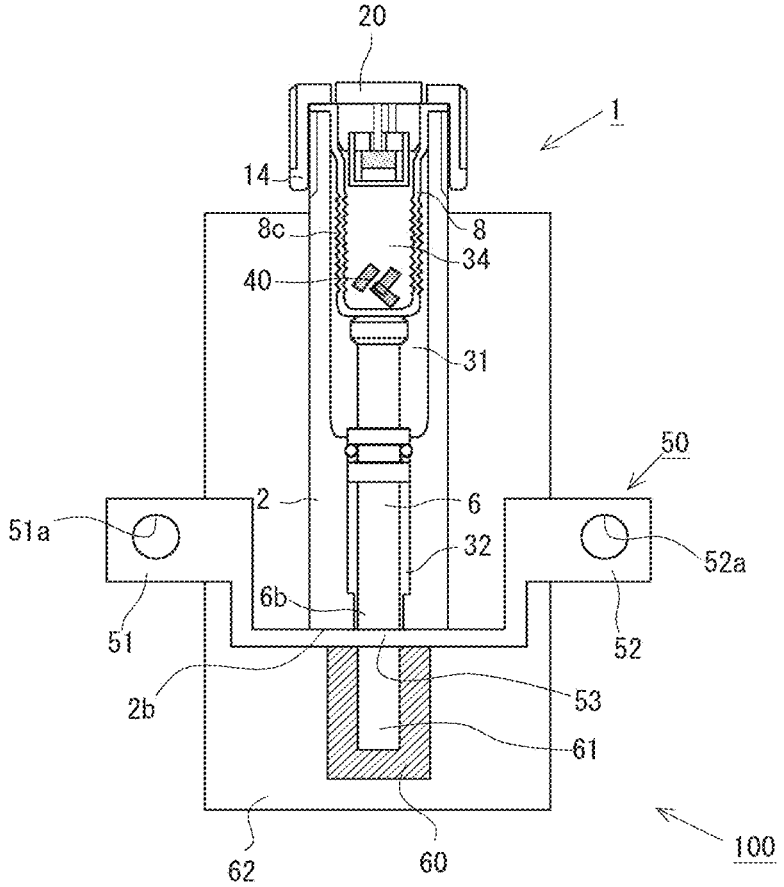
FIG. 5 is a diagram illustrating a schematic configuration of an electrical circuit breaker in which the actuator according to the first embodiment of the present invention is applied.

Therefore, as illustrated in FIG. 5 described later, in a state where the actuator 1 is used, the output surface 2*b* is brought into contact with the target object subject to a predetermined force, fixing the actuator 1 into place.

Figure 2A:
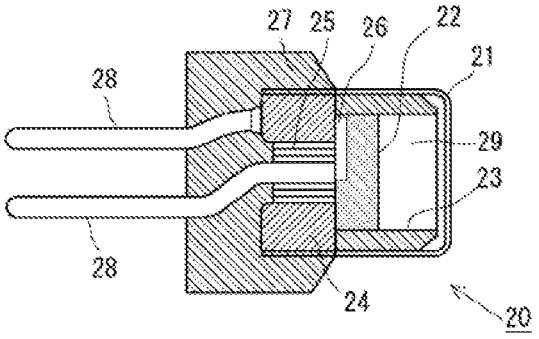
FIGS. 2A and 2B are diagrams illustrating a schematic configuration of an initiator (ignition device) mounted to the actuator illustrated in FIG. 1.
Figure 2B:
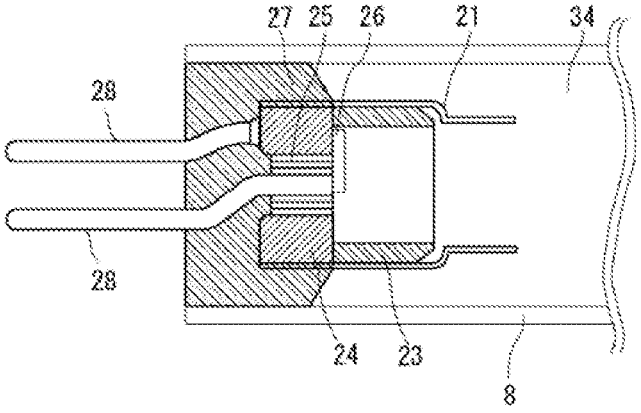

Here, the initiator 20, which is an ignition device, is disposed at a rear end portion of the actuator body 2. An example of the initiator 20 will now be described with reference to FIGS. 2A and 2B. Note that FIG. 2A illustrates the state of the initiator 20 before the gunpowder is combusted (hereinafter referred to as "pre-ignition state"), and FIG. 2B illustrates the state of the initiator 20 after the gunpowder have been combusted.

Here, the initiator 20 is an electric ignition device, and includes a cup 21 (corresponding to the partition wall member according to embodiments of the present invention) and a space 29 (corresponding to the first space according to embodiments of the present invention). The space 29 is for arranging a gunpowder 22 and is defined inside and by the cup 21 having a surface covered with an insulating cover made of resin. Then, a metal header 24 is disposed in the space, and a charge holder 23 having a cylindrical shape is provided on an upper surface of the metal header 24. The gunpowder 22 is held by the charge holder 23. At a bottom portion of the gunpowder 22, a bridge wire 26 is provided that electrically connects one of two conductive pins 28 and the metal header 24. Note that the two conductive pins 28 are fixed to the metal header 24 with an insulator 25 therebetween to ensure a mutually insulated state when no voltage is applied. Further, an opening of the cup 21 to which the two conductive pins 28 supported by the insulator 25 extend is protected in a state in which the insulating characteristics between the conductive pins 28 are favorably maintained by a resin collar 27.

In the initiator 20 thus configured, when voltage is applied between the two conductive pins 28 by an external power source, current flows into the bridge wire 26, causing the gunpowder 22 to combust. Here, the gunpowder 22 enclosed in the space 29 serving as a closed space formed by the cup 21 and the resin collar 27 is combusted while the enclosed state of the space 29 is maintained in the initial stage of the combustion. Here, the cup 21 is formed of a resin material and has a predetermined rigidity. Thus, while the shape is generally maintained until the pressure in the space 29 reaches a predetermined pressure, when the pressure exceeds the predetermined pressure, a bottom surface portion (an area facing an opening of the charge holder 23) of the cup 21 is destroyed, as illustrated in FIG. 2B. That is, the bottom surface portion of the cup 21 opens so that the space 29 and a combustion chamber 34 are in communication. At this time, the combustion product from the combustion of the gunpowder 22 is sprayed through the opening of the cup 21 that formed by the destruction of the combustion chamber 34 described above.

Examples of the gunpowder 22 used in the actuator 1 preferably include a gunpowder (ZPP) containing zirconium and potassium perchlorate, a gunpowder (THPP) containing titanium hydride and potassium perchlorate, a gunpowder (TiPP) containing titanium and potassium perchlorate, a gunpowder (APP) containing aluminum and potassium perchlorate, a gunpowder (ABO) containing aluminum and bismuth oxide, a gunpowder (AMO) containing aluminum and molybdenum oxide, a gunpowder (ACO) containing aluminum and copper oxide, a gunpowder (AFO) containing aluminum and iron oxide, or a gunpowder made from a combination of a plurality of these gunpowders. These gunpowders produce a plasma of high temperature and high pressure at the time of combustion immediately after ignition, yet exhibit the characteristic of rapidly decreasing the generated pressure when the temperature returns to normal and the combustible product is condensed since the gunpowders do not contain a gas component. Note that a gunpowder other than these may be used as the ignition charge as well.

Further, with reference to FIG. 1, an initiator cap 14 of the actuator 1 has a cross section formed into a flange shape so as to get caught on an outer surface of the initiator 20, and is fixed to the actuator body 2 with a screw. Accordingly, the initiator 20 is fixed to the actuator body 2 by the initiator cap 14, and thus the initiator 20 itself can be prevented from disengaging from the actuator body 2 by the pressure generated during ignition of the initiator 20.

Here, a stretchable casing 8 that is stretched toward the first end portion 6*a* of the output piston 6 is fixed to an end surface of the end portion 2*a* of the actuator body 2 on the initiator 20 side by a flange portion 8*a*, and is disposed in the internal space 31 of the actuator body 2, covering the cup 21 of the initiator 20. Then, the combustion chamber 34 (corresponding to the second space according to embodiments of the present invention), which is a closed space, is formed by the stretchable casing 8 and an outer surface of the cup 21 of the initiator 20. Furthermore, a gas generating agent 40 that generates a predetermined gas by combustion is disposed inside the combustion chamber 34. An example of the gas generating agent 40 is a smokeless gunpowder containing 98 wt % nitrocellulose, 0.8 wt % diphenylamine, and 1.2 wt % potassium sulfate. Additionally, various gas generating agents used in a gas generator for an airbag or for a seat belt pretensioner may also be used.

The gas generating agent 40 is combusted by exposure to the combustion product which has flowed into the combustion chamber 34 from the opening of the cup 21 by the combustion of the gunpowder 22 in the initiator 20, thereby generating a predetermined gas. Note that the stretchable casing 8 has enough strength not to be destroyed by the pressure inside the combustion chamber 34 generated from the gas generating agent 40.

Therefore, the combustion product from the gunpowder 22 and the predetermined gas from the gas generating agent 40 are maintained in a sealed state inside the stretchable casing 8. The predetermined gas generated during combustion of the gas generating agent 40 contains gas components at a normal temperature as well, and thus a rate of decrease of the generated pressure is small. Furthermore, a combustion completion time at the time of combustion of the gas generating agent 40 can be varied by adjusting the dimensions, size, and shape (particularly surface shape) of the gas generating agent 40 when disposed inside the combustion chamber 34 although the combustion completion time of the gas generating agent 40 is extremely long compared to that of the gunpowder 22 described above. The pressure generated inside the combustion chamber 34 can be adjusted appropriately by thus adjusting the amount, shape, and arrangement of the gas generating agent 40.

The stretchable casing 8 has a substantially hollow cylindrical shape and a bottom portion of the stretchable casing 8 (corresponding to the pressing portion according to embodiments of the present invention, hereinafter referred to as "pressing bottom portion") 8*b* is disposed in the interior of the actuator body 2 in a state of contact with the first end portion 6*a* of the output piston 6 in the pre-ignition state of the initiator 20. Furthermore, a bellows portion 8*c* (corresponding to the stretchable portion according to embodiments of the present invention) is provided on a side wall portion of the stretchable casing 8 facing an inner wall surface of the actuator body 2, that is, an inner wall surface of the internal space 31. This bellows portion 8*c* is stretched toward the first end portion 6*a* of the output piston 6 by a rise in pressure in the combustion chamber 34 caused by the combustion product sprayed through the opening of the cup 21 during combustion of the gunpowder 22 and the predetermined gas generated from the gas generating agent 40 combusted by the combustion product. Then, in the pre-ignition state, the bellows portion 8*c* is disposed in a folded state that allows stretching toward the first end portion 6*a* of the output piston 6. Note that the operation of the stretchable casing 8 resulting from the combustion of the gunpowder by the initiator 20 will be described later. Further, the portion serving as a side wall portion of the stretchable casing 8 where the bellows portion 8*c* is not provided, that is, the portion that does not stretch is referred to as a non-stretchable portion 8*d*.

In the actuator 1 thus configured, when the gunpowder 22 is combusted in the initiator 20, the pressure inside the initiator 20 rises as the combustion product is generated. Then, when the pressure reaches the predetermined pressure described above, the bottom surface portion of the cup 21 is destroyed, causing release of the combustion product into the combustion chamber 34 formed between the stretchable casing 8 and the cup 21, and generates the predetermined gas by the combustion of the gas generating agent 40 by being exposed to the combustion product. Note that, because the combustion product and the predetermined gas are sealed inside the combustion chamber 34, the pressure inside the combustion chamber 34 rises as the predetermined gas is generated. Accordingly, the bellows portion 8*c* is stretched, causing the pressing bottom portion 8*b* to press the first end portion 6*a* of the output piston 6. As a result, a pressure energy of the combustion chamber 34 is transmitted to the output piston 6, the output piston 6 is slidably driven inside the through-hole 32, and the second end portion 6*b* thereof protrudes from the output surface 2*b*.

In the initiator 20, because a pressure rise inside the space 29 is not inhibited by an expansion of a space capacity where the gunpowder is combusted as described above, the combustible product accumulates inside the space 29 without significant deformation of the cup 21, and the pressure inside the initiator 20 rapidly rises to a predetermined pressure until the cup 21 is destroyed. This means that, with the gas generating agent 40 that uses the combustion product as a starting point of combustion, rapid combustion initiation is possible. That is, by the quick execution of the combustion of the gunpowder and the combustion of the gas generating agent 40 inside the initiator 20, it is possible to efficiently transmit the combustion energy thereof to the output piston 6.

Figure 3:
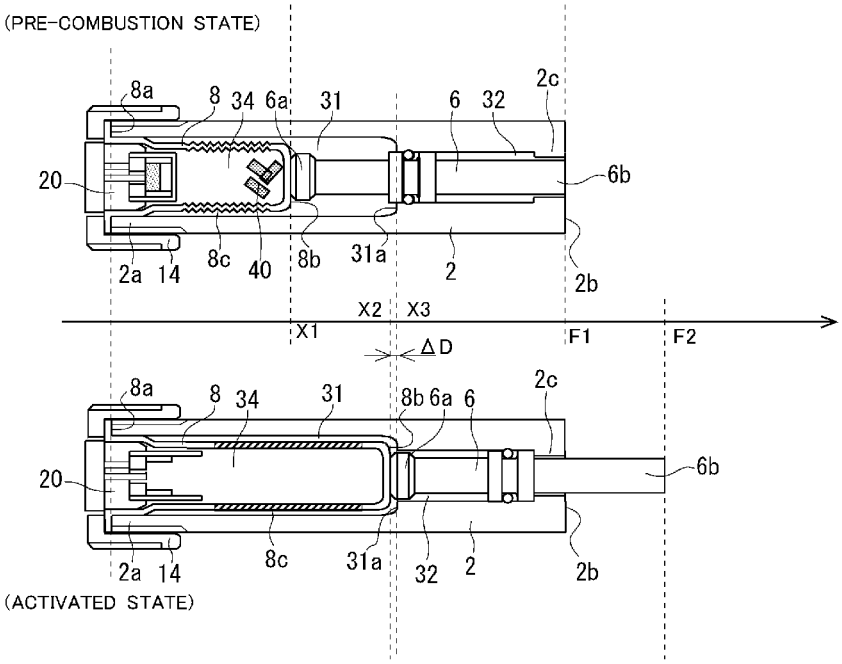
FIG. 3 is a diagram comparing a state before combustion and a state after combustion (state after activation) of a gunpowder in the initiator of the actuator illustrated in FIG. 1.

The protrusion operation of the output piston 6 of the actuator 1 executed by the stretching operation of the stretchable casing 8 initiated by the combustion of the gunpowder 22 of the initiator 20 will now be described with reference to FIG. 3. FIG. 3 illustrates the configuration of the actuator 1 in the pre-combustion state in the upper section, and the configuration of the actuator 1 in an operating state with the output piston 6 protruding as a result of combustion of the gunpowder 22 in the lower section. In the comparison of the pre-combustion state and the activated state in FIG. 3, the positions of the surface of the flange portion 8*a* of the stretchable casing 8, the surface being fixed to the actuator body 2, are aligned, and both states are illustrated side by side in the axial direction of the actuator 1.

Further, in the pre-combustion state, the position of the pressing bottom portion 8*b* of stretchable casing 8 is denoted by X1. The position of the end surface of the second end portion 6*b* of the output piston 6 at this time is denoted by F1. Here, when the gunpowder 22 is combusted and the cup 21 is destroyed as described above, the combustion product inside the combustion chamber 34 disperses and the gas generating agent 40 is combusted, resulting in a rise in pressure inside the combustion chamber 34.

The bellows portion 8*c* of the stretchable casing 8 is disposed in a folded state that allows the bellows portion 8*c* to be stretched toward the first end portion 6*a* of the output piston 6, as described above. Here, the bellows portion 8*c* is stretched toward the first end portion 6*a* of the output piston 6 by the pressure rise inside the combustion chamber 34. At this time, the pressing bottom portion 8*b* presses the first end portion 6*a* of the output piston 6. Thus, the end face of the first end portion 6*a* of the output piston 6 which is in contact with the pressing bottom portion 8*b* is the end face for receiving the combustion energy of the gunpowder 22 and the gas generating agent 40. A surface area of the pressing bottom portion 8*b* is designed to be greater than a surface area of the first end portion 6*a*. Therefore, when the bellows portion 8*c* is stretched, the pressing bottom portion 8*b* is more reliably brought into contact with the first end portion 6*a* of the output piston 6, making it possible to transmit the combustion energy to the output piston 6.

The output piston 6 continues to slide through the through-hole 32 by the pressing of the pressing bottom portion 8*b*. Then, as the output piston 6 slides, the second end portion 6*b* protrudes from the output surface 2*b*. Here, although, in a state where the second end portion 6*b* is fully protruded, the pressing bottom portion 8*b* is in contact with the end surface of the first end portion 6*a* of the output piston 6 as illustrated in the lower section of FIG. 3, the sliding of the output piston 6 is restricted because the output piston is partially in contact with the stopper portion 2*c* of the actuator body 2. The position of the pressing bottom portion 8*b* in this state is denoted by an activated position X2, and the position of the second end portion 6*b* is denoted by F2.

In this way, in the actuator 1, in the course of combustion of the gunpowder 22, the pressing bottom portion 8*b* of the stretchable casing 8 moves to the activated position X2 in an injection completion state from the starting position X1 of the pre-combustion state. A moving distance (X2−X1) resulting from the movement of this pressing bottom portion 8*b* corresponds to a moving distance of the second end portion 6*b*, that is, the amount of protrusion (F2−F1) of the second end portion 6*b*. Then, in the course of this movement, the bellows portion 8*c* of the stretchable casing 8 is stretched while a predetermined gas generated by the combustion of the gas generating agent 40 and the combustion product generated by the combustion of the gunpowder 22 are sealed in the combustion chamber 34, causing the pressing bottom portion 8*b* to move with the combustion product sealed in the combustion chamber 34 in an operating state as well. With the combustion product thus continually sealed in the stretchable casing 8, it is possible to suppress the effect of the combustion product to the outside. Further, in the actuator 1, a combustion pressure generated by the combustion of the gunpowder 22 and the combustion of the gas generating agent 40 primarily vibrates the stretchable casing 8 and thus, the actuator body 2 not becomes less susceptible to vibration so that the vibration and noise from the actuator body 2 are reduced.

Further, the stretchable casing 8 is configured to define the interior space 31 inside the actuator body 2, and include a predetermined gap ΔD with an inner wall surface 31*a* in the vicinity of an end portion of the through-hole 32 even in an activated state, that is, even with the stretchable casing 8 fully stretched. Note that, in FIG. 3, a position of the inner wall surface 31*a* is denoted by X3, and the predetermined gap ΔD exists between the position X2 of the pressing bottom portion 8*b* and the position X3 of the inner wall surface 31*a* in an operating state. That is, a distance between the pressing bottom portion 8*b* in the pre-combustion state and the inner wall surface 31*a*, which is the surface facing the pressing bottom portion 8*b* of the inner wall surface, in an axial direction of the through-hole 32 is set greater than the moving distance (X2−X1) resulting from the movement of the pressing bottom portion 8*b*. As a result, the stretchable casing 8 no longer collides with the inner wall surface 31*a*, making the stretchable casing 8 less susceptible to damage, and achieving suitable sealing of the combustion product and the like. Further, vibration of the actuator body 2 resulting from collision of the stretchable casing 8 with the inner wall surface 31*a* is suppressed, thereby reducing the vibration and noise from the actuator body 2.

Thus, the actuator 1 according to the present embodiment suppresses the effect of the combustion product of the gunpowder and the like to the outside as well as noise, and allows efficient transmission of the combustion energy of the gunpowder and the like to the output piston 6, making it possible to apply a suitable predetermined force to the target object via the output piston 6.

Modified Examples

Figure 4:
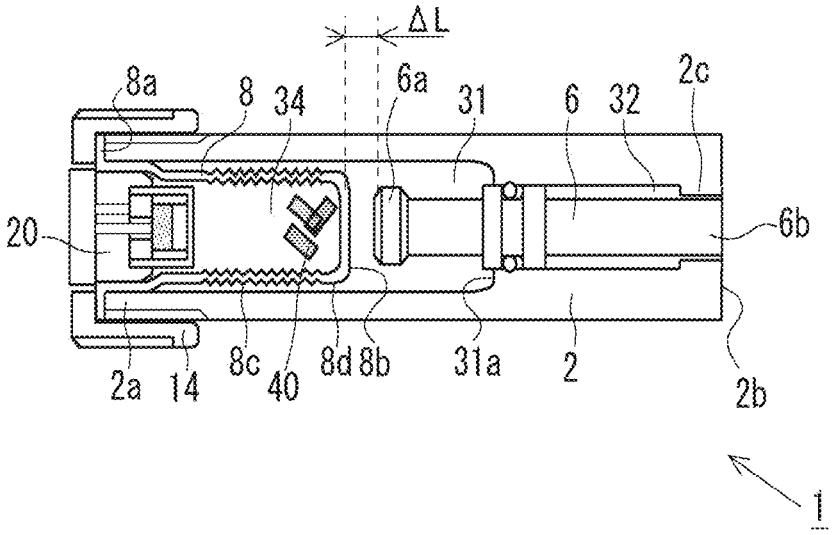
FIG. 4 is a diagram illustrating a schematic configuration of a modified example of the actuator illustrated in FIG. 1.

By substituting the embodiment described above, the stretchable casing 8 in the pre-combustion state may be disposed inside the actuator body 2 with the pressing bottom portion 8*b* separated from the first end portion 6*a* of the output piston 6, as illustrated in FIG. 4 while in the embodiment described above, in the pre-combustion state, the stretchable casing 8 is disposed in the actuator body 2 with the pressing bottom portion 8*b* in contact with the first end portion 6*a* of the output piston 6. In the configuration illustrated in FIG. 4, a separation distance between the pressing bottom portion 8*b* and the first end portion 6*a* in the pre-combustion state is denoted by ΔL. Even in a mode where the separation distance ΔL is thus maintained, the stretching of the bellows portion 8*c* associated with the pressure rise inside the combustion chamber 34 brings the pressing bottom portion 8*b* into contact with the first end portion 6*a*, and the output piston 6 is then pressed. In such a case as well, when the stretchable casing 8 is fully stretched, the pressing bottom portion 8*b* is preferably not in contact with the inner wall surface 31*a*.

Further, in the embodiment described above, the gas generating agent 40 is housed inside the combustion chamber 34, but instead of above embodiment even when the gas generating agent 40 is not housed inside the combustion chamber 34, the pressure rise inside the space 29 is not inhibited by the expansion of the space capacity where the gunpowder is combusted in the initiator 20 until the cup 21 is destroyed, and thus the pressure inside the initiator 20 rapidly rises up to the predetermined pressure. As a result, the combustion energy of the gunpowder 22 is effectively generated and can be quickly transmitted to the output piston 6, making it possible to apply a suitable predetermined force to the target object via the output piston 6. Further, similarly, the combustion product is continuously sealed by the stretchable casing 8, making it possible to suppress the effect of the combustion product to the outside as well as the combustion noise.

Application Example

FIG. 5 illustrates an electrical circuit breaker 100 as an example in which the actuator 1 is applied. The electrical circuit breaker 100 is formed by fixing the actuator 1 to a conductive piece 50 with a housing 62.

When the electrical circuit breaker 100 is fitted to an electrical circuit, the conductor piece 50 forms a portion of the electrical circuit and is a plate piece including a first connecting portion 51 and a second connecting portion 52 on both ends and a cutting portion 53 between the connecting portions. Connecting holes 51*a*, 52*a* for connection with another conductor (a lead wire, for example) in the electrical circuit are respectively provided to the first connecting portion 51 and the second connecting portion 52. Note that, the first connecting portion 51, the second connection part 52, and the cutting portion 53 may be disposed on a same generally straight line although the conductor piece 50 illustrated in FIG. 5 is formed so that the first connecting portion 51, the second connecting portion 52, and the cutting portion 53 are disposed in a step-like manner. Then, the cutting portion 53 is fixed so as to be brought into contact with the output surface 2*b* of the actuator 1. Thus, the end surface of the output piston 6 inside the actuator 1 (the end surface of the second end portion 6*b*) is in a state of facing the cutting portion 53. The conductor piece 50 thus formed is the target object in the embodiment described above and, in particular, the cutting portion 53 is a portion of the target object on which a predetermined force from the actuator 1 is applied.

Further, in the housing 62, an insulating portion 60 having a box shape and made of synthetic resin is formed on a side opposite the actuator 1 across from the cutting portion 53, and an insulating space 61 is formed in an interior thereof.

In the electrical circuit breaker 100 thus configured, when the initiator 20 is actuated by some kind of trigger signal or when the initiator 20 is actuated manually, the output piston 6 slides as described above, applying a shear force to the cutting portion 53 by a kinetic energy thereof, and the cutting portion 53 is then cut. Thus, in the conductor piece 50 that forms a portion of the electrical circuit fitted with the electrical circuit breaker 100, the electrical conduction between the first connecting portion 51 and the second connecting portion 52 is interrupted. Note that the cut piece of the cutting portion 53 cut by the output piston 6 is housed in the insulating space 61 inside the insulating portion 60 and thus the interruption of electrical conduction described above can be more reliably achieved.

As mentioned above, in the electric circuit breaker 100 where the actuator 1 according to embodiments of the present invention is applied, the actuator 1 can be efficiently driven. This is extremely useful in the electrical circuit breaker 100 that is to achieve reliable interruption of electrical conduction when necessary. Other examples of application of the actuator 1 include a drilling machine for drilling holes in a target object, and the like.

Second Embodiment

A second embodiment of the actuator 1 will now be described with reference to FIG. 6.

Figure 6:
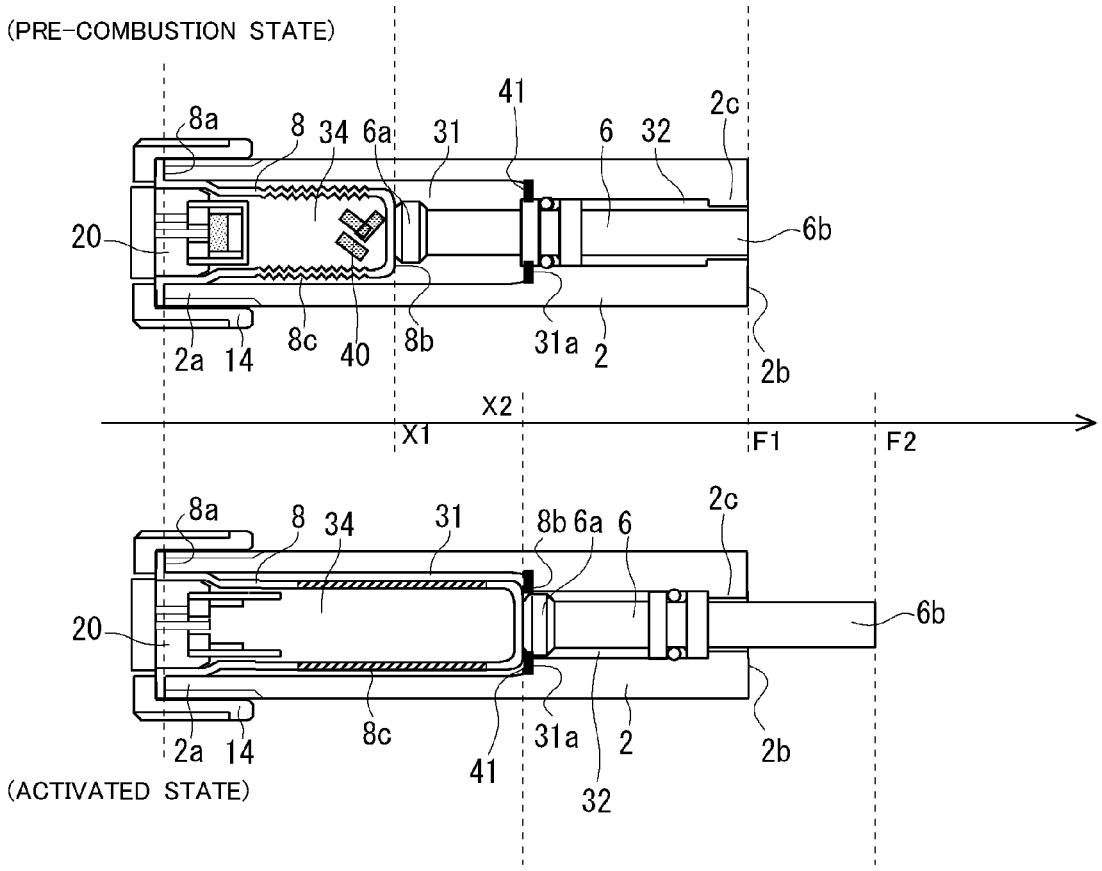
FIG. 6 is a diagram comparing a state before combustion and a state after combustion (state after activation) of a gunpowder in an initiator of an actuator according to a second embodiment of the present invention.

Note that FIG. 6, similar to FIG. 3, illustrates the configuration of the actuator 1 in the pre-combustion state in the upper section, and the configuration of the actuator 1 in an activated state in the lower section. Note that the comparison illustration of both states is the same as that illustrated in FIG. 3. In the actuator 1 of the present embodiment, a cushioning member 41 made from an elastic material is provided on the inner wall surface 31*a* of the internal space 31.

When combustion of the gunpowder 22 in the initiator 20 and combustion of the gas generating agent 40 occur, the bellows portion 8*c* is stretched. Thus the pressing bottom portion 8*b* continually presses the output piston 6 via the first end portion 6*a*. Here, when or before the bellows portion 8*c* is fully stretched, the pressing bottom portion 8*b* is brought into contact with the inner wall surface 31*a* via the cushioning member 41, inhibiting the bellows portion 8*c* from stretching. As a result, the pressing action on the output piston 6 via the stretchable casing 8 is stopped. In such a configuration as well, similar to the first embodiment described above, the external effects of the combustion product and the predetermined gas are suppressed, and efficient driving of the output piston 6 is possible. Furthermore, the pressing bottom portion 8*b* is brought into contact with the cushioning member 41, making it possible to reduce the impact received from the inner wall surface 31*a* side at the time of contact and thus make the stretchable casing 8 less susceptible to damage, achieve suitable sealing of the combustion product and the like, and suppress vibration of the actuator body 2 as a result of collision. As a result, the vibration and the noise from the actuator body 2 are reduced.

Third Embodiment

A third embodiment of the actuator 1 will now be described. As described above, in the actuator 1, the stretchable casing 8 is stretched, pressing the output piston 6. Accordingly, to suitably maintain the sealed state of the combustion product of the gunpowder 22 and the predetermined gas of the gas generating agent 40 inside the combustion chamber 34, a strength of the pressing bottom portion 8*b* is preferably increased taking into consideration the fact that the energy transmitted to the piston is applied to the pressing bottom portion 8*b* of the stretchable casing 8. Thus, a casing thickness of the pressing bottom portion 8*b* may be greater than a casing thickness of the non-stretchable portion 8*d* of the side wall portion of the stretchable casing 8.

Figure 7:
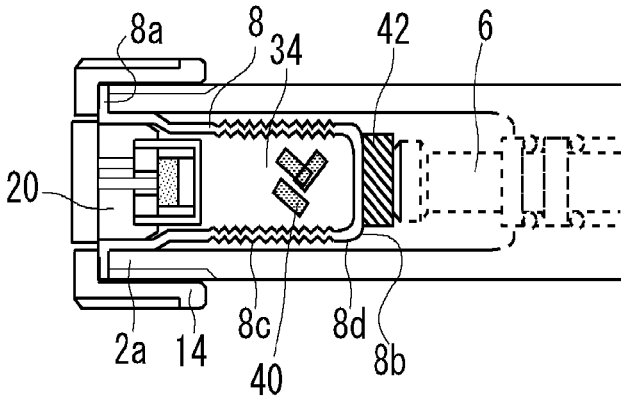
FIG. 7 is a diagram schematically illustrating a portion of an actuator according to a third embodiment of the present invention.

Alternatively, as illustrated in FIG. 7, to improve the strength of the pressing bottom portion 8*b*, a reinforcing plate 42 having a predetermined thickness may be provided on an outer surface or an inner surface of the pressing bottom portion 8*b*. The reinforcing plate 42 may be formed of the same material as the stretchable casing 8, or may be formed from another material suitable for reinforcement. Further, a predetermined thickness of the reinforcing plate 42 is a thickness that imparts strength to the reinforcing plate 42 to the extent that destruction of the stretchable casing 8 can be suppressed.

What is claimed is:

1. An actuator having an actuator body with a through-hole formed in an axial direction and an output piston portion slidably disposed inside the through-hole, the output piston portion being configured to protrude from an output surface of the actuator body and apply a predetermined force to a target object, the actuator comprising:

an ignition device comprising a partition wall member forming a first space configured to house a gunpowder and made from a predetermined rigid material so as to be destroyed by a rise in pressure in the first space in response to the gunpowder being combusted;

a casing including a base portion being fixed to the actuator body near the ignition device, and being disposed in a space inside the actuator body covering the ignition device, the casing defining a second space between an inner space of the casing and the partition wall member of the ignition device, and sealing, inside the second space, a combustion product generated by combustion of the gunpowder by the ignition device; and a gas generating agent contained in the second space and configured to be combusted by the combustion product after the gunpowder is combusted, wherein the casing comprises:

a stretchable portion configured to, via a rise in pressure inside the second space from the combustion of the gunpowder and the combustion of the gas generating agent, stretch in an approaching direction so as to cause the casing to approach a predetermined end portion of the output piston portion opposite an end portion that protrudes from the output surface; and a pressing portion provided in a portion of the casing and configured to press the predetermined end portion of the output piston portion via stretching of the stretchable portion.

2. The actuator according to claim 1, wherein the stretchable portion is formed in a side wall portion of the casing facing an inner wall surface extending in the axial direction of the actuator body by being folded into a bellows shape prior to the combustion of the gunpowder, and is configured to stretch in the axial direction in response to the combustion of the gunpowder and the combustion of the gas generating agent.

3. The actuator according to claim 1, wherein the portion of the casing comprises an end surface that is on a leading end side of the casing and has a surface area greater than a surface area of an end surface of the predetermined end portion of the output piston portion.

4. The actuator according to claim 1, wherein the portion of the casing is thicker than other portions of the casing.

5. The actuator according to claim 1, further comprising a reinforcing plate having a predetermined thickness and provided on an inner surface or an outer surface of the portion of the casing, the reinforcing plate arranged substantially perpendicular to the stretchable portion.

6. The actuator according to claim 1, wherein the casing, prior to the combustion of the gunpowder, is disposed inside the actuator body with the pressing portion in contact with the predetermined end portion of the output piston portion.

7. The actuator according to claim 1, wherein the actuator is configured such that, in a state where the stretchable portion is fully stretched via the combustion of the gunpowder and the combustion of the gas generating agent, a predetermined gap exists between the portion of the casing and a predetermined inner wall surface forming an internal space of the actuator body, located in a vicinity of an end portion of the through-hole, and facing the portion of the casing.

8. The actuator according to claim 1, further comprising:

a cushioning member provided on a predetermined inner wall surface forming an internal space of the actuator body, located in a vicinity of an end surface of the through-hole, and facing the portion of the casing, wherein the cushioning member is configured to stop the stretching of the stretchable portion upon contact with the stretchable portion stretched by the combustion of the gunpowder and the combustion of the gas generating agent.

9. The actuator according to claim 1, wherein the stretchable portion at least partially surrounds the second space.

10. The actuator according to claim 9, wherein the stretchable portion at least partially surrounds the gas generating agent prior to the combustion of the gas generating agent.

11. The actuator according to claim 1, wherein the casing further comprises a non-stretchable portion disposed between the pressing portion and the stretchable portion.

12. The actuator according to claim 11, wherein the non-stretchable portion is thicker than the pressing portion.

13. The actuator according to claim 1, wherein the combustion of the gas generating agent is configured to produce a predetermined gas in the second space, the predetermined gas configured to stretch the stretchable portion.

14. The actuator according to claim 13, wherein the combustion product of the gunpowder and the predetermined gas are configured to be maintained in a sealed state inside the casing after the combustion of the gas generating agent.

15. The actuator according to claim 1, wherein the gas generating agent comprises a smokeless gunpowder containing 98 wt % nitrocellulose, 0.8 wt % diphenylamine, 1.2 wt % potassium sulfate, or one or more gas generating agents used in a gas generator for an airbag or for a seat belt pretensioner.

16. The actuator according to claim 5, wherein the portion of the casing is disposed at an end of the casing facing the predetermined end portion of the output piston portion.

17. The actuator according to claim 1, wherein the gas generating agent is configured to be isolated from the gunpowder housed in the first space prior to the combustion of the gunpowder.

18. The actuator according to claim 17, wherein the combustion product is configured to move to the second space by the destruction of the partition wall member in response to the combustion of the gunpowder, the gas generating agent configured to be exposed to and combusted by the combustion product moved from the first space in response to the combustion of the gunpowder.

* * * * *